US006726490B2

(12) United States Patent
Kamiya

(10) Patent No.: US 6,726,490 B2
(45) Date of Patent: Apr. 27, 2004

(54) CONNECTOR PARTIALLY HAVING LARGER WIRE BONDING AREA

(75) Inventor: Arihiro Kamiya, Anjo (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/319,467

(22) Filed: Dec. 16, 2002

(65) Prior Publication Data

US 2003/0143875 A1 Jul. 31, 2003

(30) Foreign Application Priority Data

Jan. 28, 2002 (JP) ..... 2002-018396

(51) Int. Cl.[7] ..... H01R 12/00
(52) U.S. Cl. ..... 439/79; 439/76.1
(58) Field of Search ..... 439/79, 60, 83, 439/924.1, 507, 510, 76.1

(56) References Cited

U.S. PATENT DOCUMENTS 5,263,880 A * 11/1993 Schwarz et al. ..... 439/733.1
6,565,365 B2 * 5/2003 Lawlyes ..... 439/79

FOREIGN PATENT DOCUMENTS

| | | |
|---|---|---|
| JP | 4-8431 | 1/1992 |
| JP | 6-36578 | 9/1994 |
| JP | 7-27672 | 6/1995 |

* cited by examiner

*Primary Examiner*—Tho D. Ta
(74) *Attorney, Agent, or Firm*—Nixon & Vanderhye PC

(57) ABSTRACT

The bonding area of an outer contact terminal of a connector and the bonding area of an inner contact terminal are rectangular and different in width. The bonding area of the outer terminal is wider than that of the inner terminal. A single aluminum wire is used for connecting the bonding area of the inner terminal to a substrate, and two aluminum wires are used for connecting the bonding area of the outer terminal to the substrate. The outer terminals generate more heat and are located near the periphery of the connector to facilitate heat removal.

22 Claims, 6 Drawing Sheets

CONNECTOR PARTIALLY HAVING LARGER WIRE BONDING AREA

CROSS REFERENCE TO RELATED APPLICATION

This application is based on and incorporates herein by reference Japanese Patent Application No. 2002-18396 filed on Jan. 28, 2002.

BACKGROUND OF THE INVENTION

The present invention relates to a connector which is used for an electric connection in an electronic control device installed in, for example, an engine room of an automobile. In particular, the invention relates to bonding areas of the connector.

In an engine room of an automobile, an electronic control unit (ECU) is provided to execute various controls for the automobile. The ECU is provided with a connector (for instance, a plastic connector) to connect the ECU with various external devices such as sensors or actuators.

The connector is electrically linked with a substrate within the ECU, for instance, by aluminum wires. The connector has a plurality of long metal contact terminals which penetrate the body of the connector. In a section connecting to the substrate within the ECU, planar connecting areas (bonding areas) formed on the ends of the contact terminals are exposed to be bonded with the aluminum wire.

Incidentally, recent requirements for miniaturization of the connector have reduced the spaces between the contact terminals (connector pitch) and made the aluminum wire thinner. These requirements restrict the choice of bonding direction.

Since the restriction in the connector pitch limits the width of the bonding area, the bonding direction must be in the longitudinal direction of the rectangular bonding area. Other directions are impractical, so that design flexibility is limited.

Such an existing design is shown in FIG. 8. To make an electric connection between a substrate P1 and a connector P2 with a narrow connector pitch, an end of a contact terminal P3 has a longitudinal bonding area P4. It is thus necessary for the bonding area P4 to be bonded by an aluminum wire P6 to a bonding area P5 of the substrate P1 in the longitudinal direction as shown.

Recent ECUs require relatively high permissible electric current capacity in the contact and relatively high electric current to carry the load of the ECU. A plurality of bonding wires are therefore necessary for connecting high current contacts (power pins) with the substrate; however, it is difficult to accomplish this due to the narrow contact spacing.

It is difficult for a load circuit, such as a solenoid which requires a larger circuit area, to be densely packed unlike a signal line connection, so that the circuit wires are likely to be relatively long. Long wires are undesirable due to an increase in resistance. However, under the above bonding restriction, the load circuit must have relatively long wires on the substrate and the power pin wires will be parallel with signal lines, which causes problems such as increased wiring resistance and restricted circuit layout.

SUMMARY OF THE INVENTION

An object of the present invention is to provide, even under condition of narrowing contact spacing, a connector in which restrictions regarding a bonding direction is reduced and flexibility of circuit layout is enhanced.

To achieve above object, the connector is provided with a relatively larger bonding area only in an outer periphery of a connecting section. The larger bonding area permits more than one bonding direction and increases the maximum number of wires that can be bonded to the bonding area. The outer location improves heat dissipation from the connecting section of the connector, so that the permissible electric current capacity is increased.

BRIEF DESCRIPTION OF THE DRAWINGS

The above and other objects, features and advantages of the present invention, will become more apparent from the following detailed description made with reference to the accompanying drawings. In the drawings.

DETAILED DESCRIPTION OF THE PREFERRED EMBODIMENTS

Figure 1:
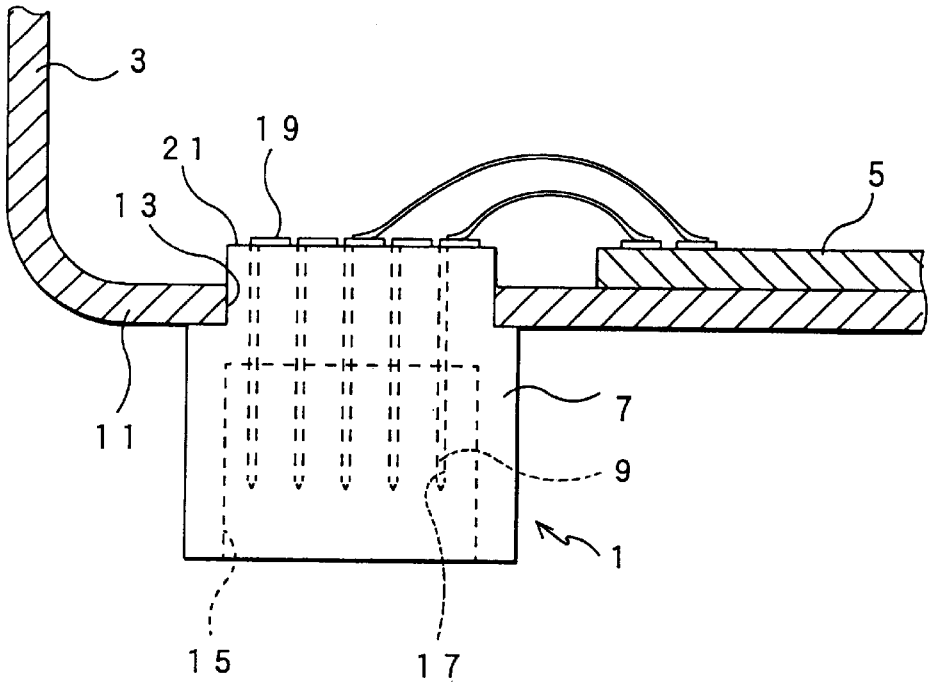
FIG. 1 is a cross-sectional diagram of a connector according to a first embodiment of the present invention.

A connector and its installation according to a first embodiment of the present invention are explained with reference to FIGS. 1 and 2. Referring to FIG. 1, a connector 1 is provided in an electronic control unit (ECU) housing 3 along with a substrate 5 located inside the housing 3. The connector is fitted in an opening 13 of a bottom 11 of the housing 3 and is used to electrically connect the substrate 5 with external devices such as cords (not shown).

The connector 1 consists of a rectangular plastic body 7 and a plurality of contact terminals 9, which longitudinally penetrate the body 7, as shown in FIG. 1. The connector has, toward the outside of the housing 3 (lower side of FIG. 1), a concave connecting portion 15, in which terminal ends 17 of the contact terminals 9 protrude to contact metal contacts of the external devices (not shown). Toward the inside of the housing 3 (upper side of FIG. 1), bonding areas 19, in which roots of the contact terminals 9, which are bent perpendicularly to the terminal ends 17, are exposed on an inside-surface 21 and face the inside of the housing 3, as described later.

Figure 2:
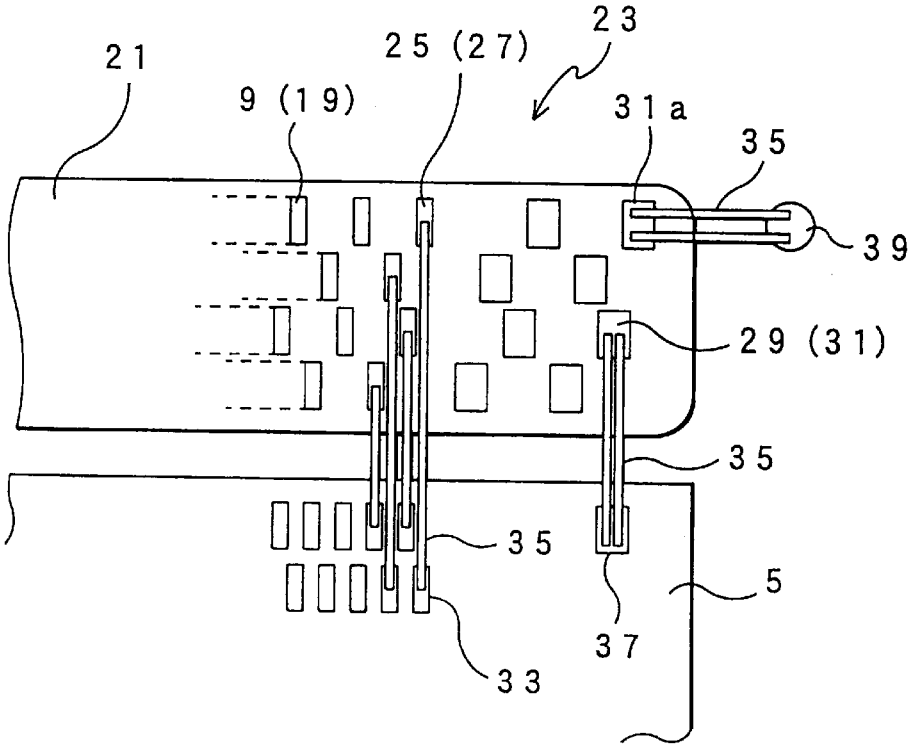
FIG. 2 is a diagrammatic plan view of the connector facing an inside of a housing according to the first embodiment.

As shown in FIG. 2, the bonding areas 19 of the contact terminals 9 are planar and substantially rectangular and extend along an outer surface 21 of the connector 1. At the upper part of FIG. 2, a substantially rectangular connecting section 23 is electrically connected with the substrate 5. The connecting section 23 faces the inside of the housing 3.

The contact terminals 9 include, in the connecting section 23, a central contact terminal 25 and an outer contact terminal 29, each of which has a different bonding area shape (a central bonding area 27 and an outer bonding area 31 respectively). The outer bonding area 31 is wider (in the horizontal direction in FIG. 2) than the central bonding area 27, and both areas 27, 31 have the same dimensions in the vertical direction of FIG. 2. In addition, the outer bonding areas 31 are provided in both of the right and left (not shown in FIG. 2) ends of the connecting section 23.

The central bonding area 27 is electrically connected, in the vertical direction of FIG. 2, to a first bonding area 33 of the substrate 5 with only an aluminum wire 35. The first bonding area 33 has a shape similar to that of the central bonding area 27.

The outer bonding area 31 is electrically connected, in the vertical direction of FIG. 2, to a second bonding area 37 of the substrate 5 with two aluminum wires 35. The second bonding area 37 has a shape similar to that of the outer bonding area 31 and wider than the first bonding area 33.

Moreover, another outer bonding area 31*a* is electrically bonded, in the horizontal direction of FIG. 2, to a third bonding area 39, which is provided in the housing 3, with two aluminum wires 35.

Figure 3:
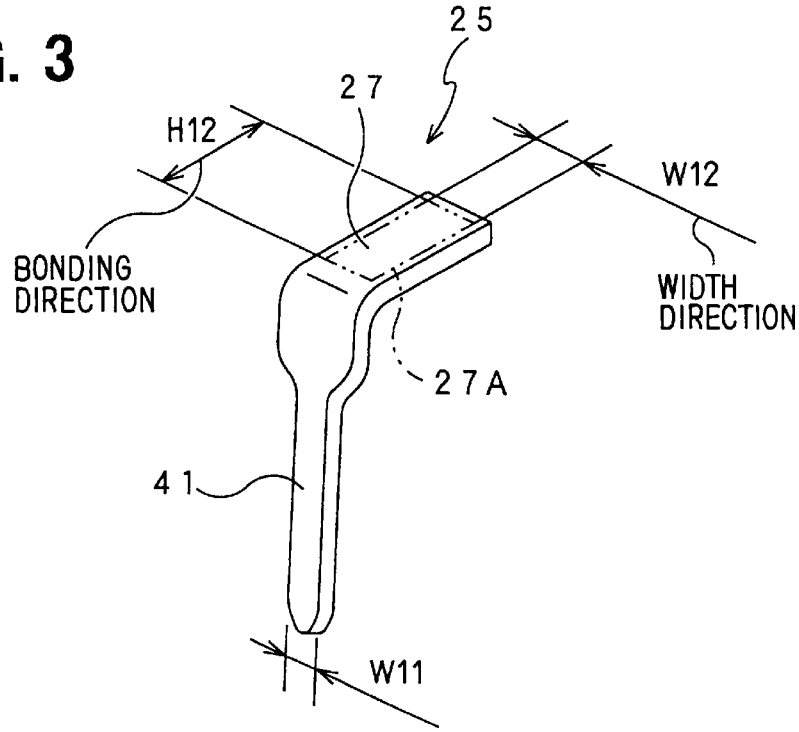
FIG. 3 is a perspective view of a central contact terminal according to the first embodiment.

The configuration of the contact terminals 9 is explained as follows. As shown FIG. 3, the central contact terminal 25 is a long metal strip that is bent at a right angle. The central bonding area 27, which is bonded to an aluminum wire 35, is perpendicular to the terminal end 41.

The effective bonding area 27A, that is, the area in which it is practical to form a bond, on the surface of the central bonding area 27 has a length H12 (for instance 2 mm) and a width W12 (for instance 0.6 mm). The length H12 is measured in the bonding direction. The width W12 is measured in a direction that is perpendicular to the bonding direction. In addition, the terminal end 41 of the central contact terminal 25 has a width W11 (for instance 0.64 mm).

Figure 4:
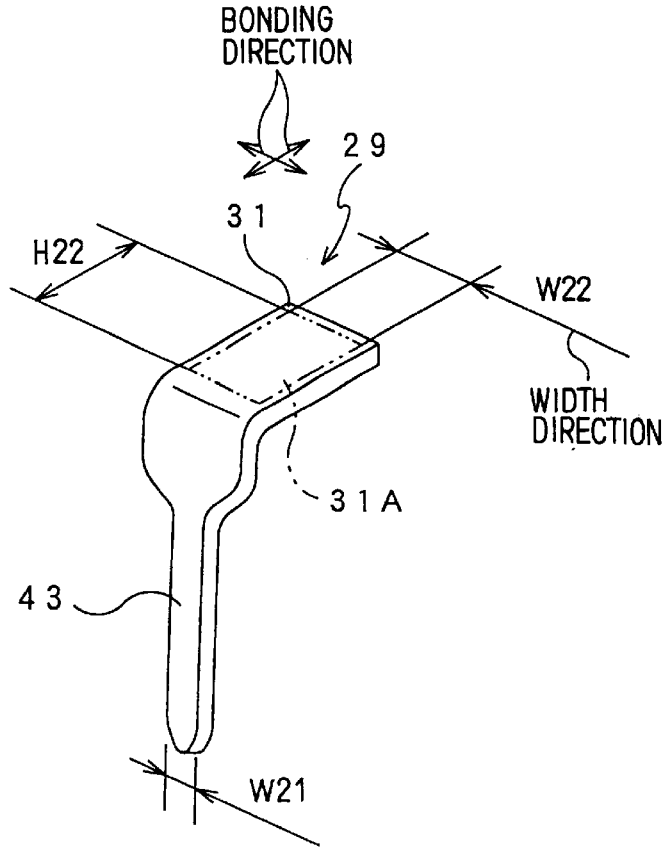
FIG. 4 is a perspective view of an outer contact terminal according to the first embodiment.

On the other hand, as shown in FIG. 4, the outer contact terminal 29 is also a long metal strip in which an end of the strip is bent at a right angle. The outer bonding area 31, which is bonded with an aluminum wire 35, is perpendicular to the terminal end 43.

The effective bonding area 31A on the surface of the central bonding area 31 has a length H22 (for instance 2 mm) and a width W22 (for instance 1.6 mm). In addition, the terminal end 43 of the outer contact terminal 29 has a width W21 (for instance 1.5 mm). Regarding the outer bonding area 31, the wires 35 may extend in the vertical or the horizontal direction of FIG. 2.

Figure 5A:
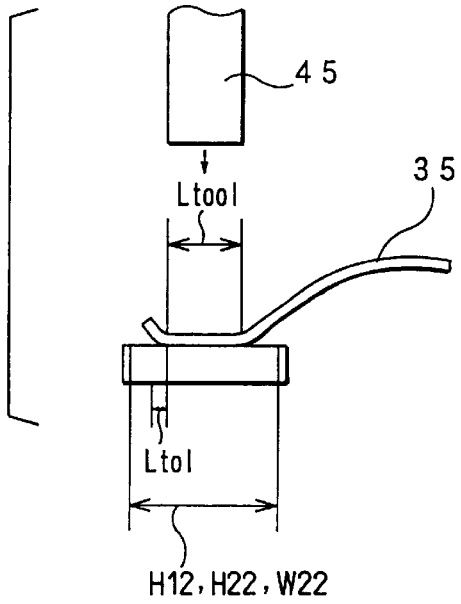
FIG. 5A is a diagrammatic side view of a wire bond.
Figure 5B:
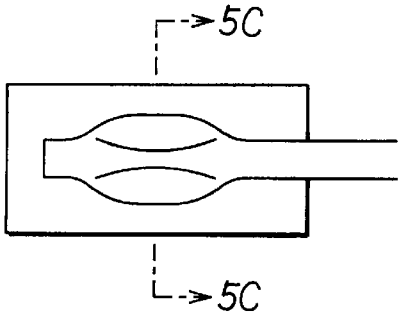
FIG. 5B is a diagrammatic plan view of the wire bond.
Figure 5C:
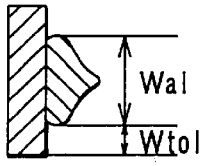
FIG. 5C is a cross-sectional view of the wire bond taken along line 5C to 5C.

Referring to FIG. 5A, an aluminum wire 35 is bonded by a bonding tool 45 that presses and deforms the aluminum wire 35 with ultrasonic vibration energy. The tool length Ltool is a tolerance measured in the longitudinal direction of the wire. A tolerance Wtol is measured in the vertical direction of FIG. 5C. The resultant bonded width of the aluminum wire 35 is Wal.

The relationships among the above four parameters are as follows: In the central bonding area 27, $$W12 \geqq \text{Wal}+\text{Wtol}, \text{ and}$$

$$H12 \geqq \text{Ltool}+\text{Ltol}.$$

In the outer bonding area 31, $$W22 \geqq \text{Ltool}+\text{Wtol}, \text{ and}$$

$$H22 \geqq \text{Ltool}+\text{Ltol}.$$

Provided that $$\text{Ltool} > \text{Wal}.$$

Hence, in the illustrated embodiment, the width W22 and the length H22 of the effective bonding area 31A on the outer bonding area 31 are greater than the width W12 in the effective bonding area 27A of the central bonding area 27.

The effective bonding area 31A of the outer bonding area 31 is thus greater than the effective bonding area 27A on the central bonding area 27. Since the effective bonding area must be within the bonding area, it may be inward by not less than 0.1 mm from the perimeter of the bonding area.

Since the width W22 of the outer bonding area 31 is greater than width W12 of the central bonding area 27, the wires connected to the outer bonding area 31 can extend not only vertically but also horizontally (in FIG. 2).

Since the connecting direction between the substrate 5 and the contact terminal 9 is not limited, the product design is very flexible. In addition, the outer bonding area 31 is wide enough to accommodate more than one aluminum wire (for instance two wires), to increase the permissible electric current capacity.

If the outer contact terminal 29 is used as a high permissible electric current capacity contact, heat generated from contact resistance will dissipate effectively since the terminal 29 is located near the outer edge of the connector 1.

Moreover, the high heat dissipation permits the permissible electric current capacity to be increased. Since only the outer bonding area 29 is relatively wide for high permissible electric current capacity, the total connecting section 23 is relatively small.

A second embodiment is explained with reference to FIG. 6. A connector 51 is provided in an ECU housing 53 along with a substrate 55 located inside the housing 53. The connector is fitted into an opening 61 located in the housing 53 and has terminal ends 67 that are parallel with a bottom 63 to electrically connect the substrate 55 with external devices (not shown).

Figure 6:
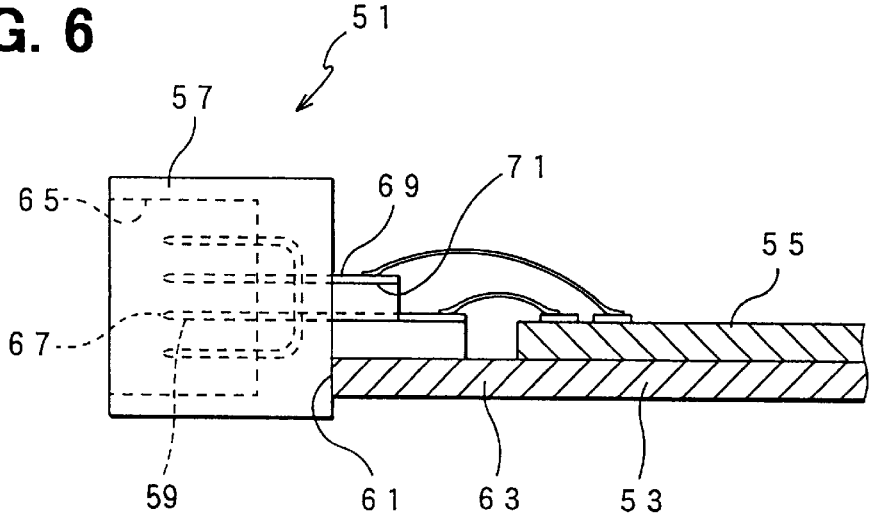
FIG. 6 is a cross-sectional diagram of a connector according to a second embodiment.

The connector 51 consists of a rectangular plastic body 57 and a plurality of electrically conductive metal contact terminals 59 which laterally penetrate the body 57, as shown in FIG. 6. The connector 51 has, outside the housing 53 (left side of FIG. 6), a concave connecting portion 65 where terminal ends 67 protrude to contact the external devices (not shown). The connector 51 has also, inside the housing 53 (right side of FIG. 6), flat bonding areas 69 that extend on an upper surface 71 of the connector 51.

Figure 7A:
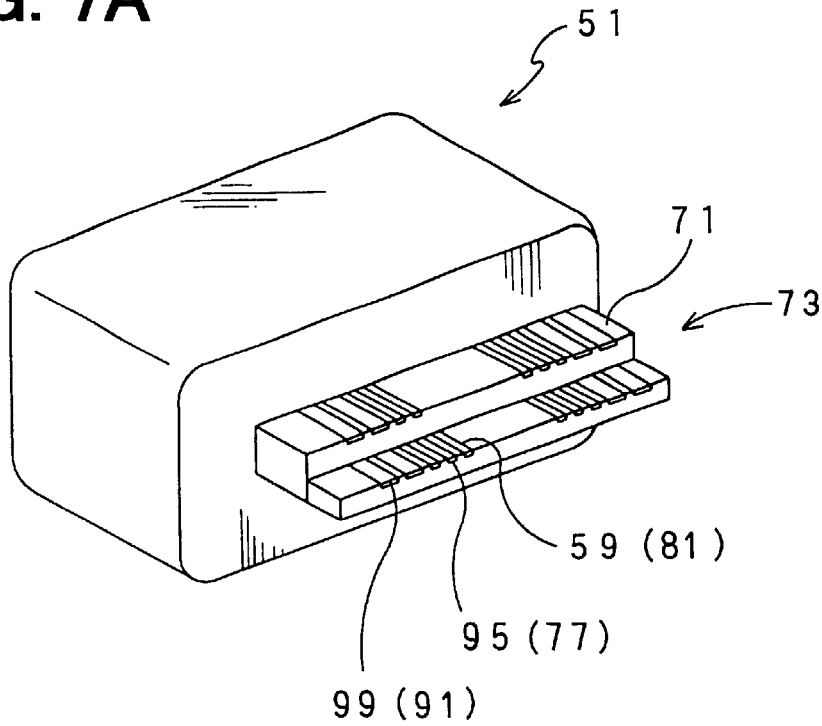
FIG. 7A is a perspective view of the connector according to the second embodiment.
Figure 7B:
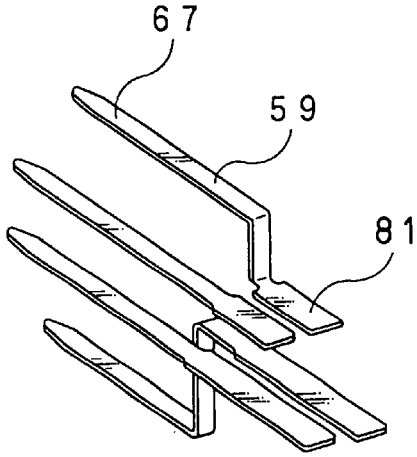
FIG. 7B is a perspective view of contact terminals according to the second embodiment.
Figure 8:
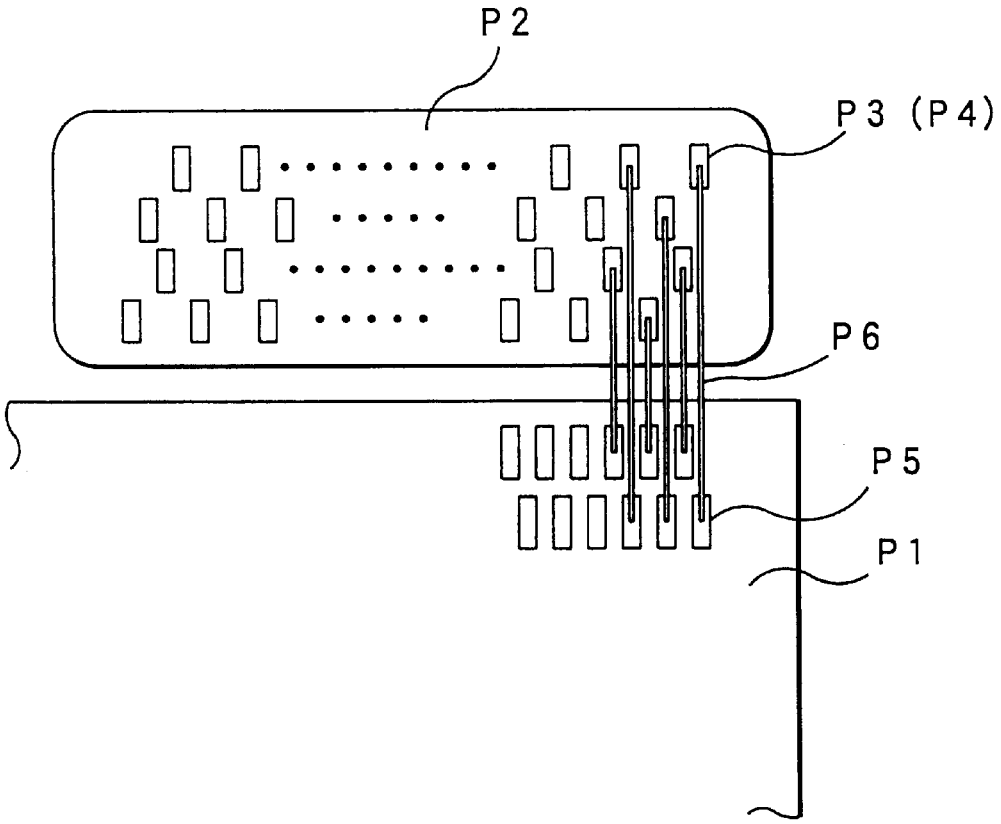
FIG. 8 RELATED ART
FIG. 8 is a diagrammatic plan view of a related art connector.

Referring to FIG. 7A, a member facing the inside of the housing 53 protrudes in a staircase pattern, and rectangular bonding areas 81 are exposed to form a connecting section 73. As shown in FIG. 7B, each of the contact terminals 59 is (for instance, alternately) bent in a staircase pattern for the terminal ends 67 to align vertically in four rows (see FIG. 6) within the concave connecting portion 65.

In the second embodiment, the contact terminals 59 also include, in the connecting section 73, a central contact terminal 95 and an outer contact terminal 99, both of which have two different shaped bonding areas (a central bonding area 77 and an outer bonding area 91). The outer bonding area 91 has a greater width than the central bonding area 77.

Here, Ltool, the pressing width of the bonding tool 45, Ltol and Wtol, position tolerances in bonding, and Wal, the resultant bonded aluminum wire width, are related in a manner similar to that of the first embodiment. The second embodiment thus provides the opportunity to choose a different connecting direction while providing the same advantages as the first embodiment does.

The illustrated embodiments may be further modified as follows:

(1) A larger outer bonding area may be provided not only at one end, as illustrated, but at any peripheral edge of a connector.

Figure 9:
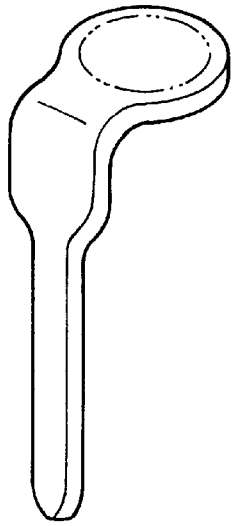
FIG. 9 is a perspective view of a circle-type contact terminal.
Figure 10:
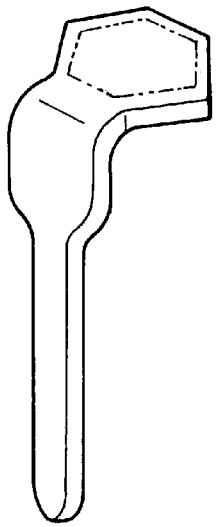
FIG. 10 is a perspective view of a polygon-type contact terminal.

(2) The bonding area may be not only a rectangle but also a circle or a polygon shown in FIG. 9 or FIG. 10. The circle may have a diameter that is the same as the longer of width and length of the rectangle, and the polygon may be inscribed by the circle.

What is claimed is:

1. A connector that is connected to a substrate by bonding with metal wires, the connector comprising a connecting section, which includes a plurality of contact terminals, wherein the terminals include:

a first contact terminal, which includes a bonding area; and a second contact terminal, which includes a bonding area, wherein the second contact terminal is located in an outer periphery of the connector, and the bonding area of the second contact terminal is greater than that of the first contact terminal.

2. A connector as recited in claim 1, wherein the bonding area of the second contact terminal has a greater width than that of the first contact terminal.

3. A connector as recited in claim 1, wherein each of the contact terminals has a contact area, which connects with an external device, wherein the contact area of the first contact terminal is perpendicular to the bonding area of the first contact terminal, and the contact area of the second contact terminal is perpendicular to the bonding area of the second contact terminal.

4. A connector as recited in claim 1, wherein each of the contact terminals has a contact area, which connects with an external device, wherein the contact area of the first contact terminal is parallel to the bonding area of the first contact terminal, and the contact area of the second contact terminal is parallel to the bonding area of the second contact terminal.

5. A connector as recited in claim 1, wherein the second contact terminal has greater permissible electric current capacity than the first contact terminal.

6. A connector as recited in claim 1, wherein the second contact terminal has a bonding area in which a metal wire is able to be bonded in a plurality of bonding directions.

7. A connector as recited in claim 1, wherein the second contact terminal has a bonding area in which the bonding is able to be executed with a plurality of metal wires.

8. A connector as recited in claim 1, wherein the bonding area of the second contact terminal has, in a bonding direction, a length that is greater than the sum of a length pressed by a bonding tool in the bonding direction and a tolerance in the bonding direction.

9. A connector as recited in claim 1, wherein the bonding area of the first contact terminal and the bonding area of the second contact terminal are defined on a common plane.

10. A connector as recited in claim 1, wherein the bonding area of the second contact terminal is rectangular.

11. A connector as recited in claim 10, wherein the bonding area of the second contact terminal is rectangular and has, in either of a longitudinal and a lateral direction of the rectangle, a length which is greater than the sum of a length pressed by a bonding tool in a bonding direction and a tolerance in the bonding direction.

12. A connector as recited in claim 1, wherein the bonding area of the second contact terminal is circular.

13. A connector as recited in claim 12, wherein the bonding area of the second contact terminal is circular and has a diameter that is greater than the sum of a length pressed by a bonding tool in a bonding direction and a tolerance in the bonding direction.

14. A connector as recited in claim 1, wherein the bonding area of the second contact terminal is polygonal with more than four sides.

15. A connector as recited in claim 14, wherein the bonding area of the second contact terminal is polygonal and has an inscribed circle whose diameter is greater than the sum of a length pressed by a bonding tool in a bonding direction and a tolerance in the bonding direction.

16. A connector that is connected to a substrate by bonding with metal wires, the connector comprising a connecting section, which includes a plurality of contact terminals, wherein the terminals include:

a first contact terminal, which includes a bonding area whose dimensions can be used for bonding; and a second contact terminal, which includes a bonding area whose dimensions can be used for bonding, wherein the second contact terminal is located in an outer periphery of the connector, and wherein the bonding area of the second contact terminal is greater than the bonding area of the first contact terminal.

17. A connector according to claim 16, wherein the bonding area of the first contact terminal and the bonding area of the second contact terminal are formed on a first surface of the connector, wherein the bonding area of the second contact terminal is located in an outer periphery of the first surface of the connector, and wherein at least one of the dimensions of the bonding area second contact terminal is greater than at least one of the dimensions of the bonding area first contact terminal.

18. A connector that is connected to a substrate by metal wires, the connector comprising a connecting section, which includes a plurality of contact terminals, wherein the terminals include:

a first contact terminal, which includes a bonding area; and a second contact terminal, which includes a bonding area, wherein the second contact terminal is located in an outer periphery of the connector, and the bonding area of the second contact terminal has a greater dimension in a predetermined direction than that of the bonding area of the first contact terminal.

19. A connector as recited in claim 18, wherein the bonding area of the second contact terminal has a greater width than that of the first contact terminal.

20. A connector as recited in claim 18, wherein each of the contact terminals has a contact area, which connects with an external device, wherein the contact area of the first contact terminal is perpendicular to the bonding area of the first contact terminal, and the contact area of the second contact terminal is perpendicular to the bonding area of the second contact terminal.

21. A connector as recited in claim 18, wherein the second contact terminal has a bonding area in which a metal wire is able to be bonded in a plurality of bonding directions.

22. A connector as recited in claim 18, wherein the bonding area of the first contact terminal and bonding area of the second contact terminal are defined on a common plane.

* * * * *